US006112979A

United States Patent [19]

Deger

[11] Patent Number: 6,112,979

[45] Date of Patent: Sep. 5, 2000

[54] SPAGHETTI BOX DISPENSER CONSTRUCTION

[76] Inventor: James J. Deger, 3260 Sanatoga Rd., Pottstown, Pa. 19464

[21] Appl. No.: 09/435,429

[22] Filed: Nov. 8, 1999

[51] Int. Cl.[7] ..... B65D 5/42

[52] U.S. Cl. ..... 229/122; 221/280; 221/305; 229/122.1

[58] Field of Search ..... 229/122, 122.1, 229/162; 221/259, 280, 305, 312 R

[56] References Cited

U.S. PATENT DOCUMENTS

| | | | |
|---|---|---|---|
| 2,299,027 | 10/1942 | Novak | 229/122.1 |
| 2,556,707 | 6/1951 | Rendall et al. | 229/122.1 |
| 3,750,930 | 8/1973 | Roth | 229/122 |
| 3,981,430 | 9/1976 | Keim . | |
| 4,039,118 | 8/1977 | Kawaoka | 229/122.1 |
| 4,142,635 | 3/1979 | Capo et al. . | |
| 4,216,861 | 8/1980 | Oliff | 206/427 |
| 4,283,000 | 8/1981 | White | 229/122.1 |
| 4,377,237 | 3/1983 | Pawlowski . | |
| 4,953,781 | 9/1990 | Bryan | 229/125.11 |
| 5,060,853 | 10/1991 | Gulliver et al. | 229/162 |
| 5,328,082 | 7/1994 | Fritz et al. | 221/305 |
| 5,443,204 | 8/1995 | O'Donnell et al. | 229/122 |

FOREIGN PATENT DOCUMENTS

| | | | |
|---|---|---|---|
| 473909 | 3/1992 | European Pat. Off. | 229/122 |

*Primary Examiner*—Gary E. Elkins
*Attorney, Agent, or Firm*—Henderson & Sturm LLP

[57] ABSTRACT

A spaghetti box dispensing construction 10 for facilitating the dispensing of a selected quantity of strands 101 of spaghetti 100 without difficulty or breakage. The construction 10 includes an elongated housing member 20 having a roof panel 21, a floor panel 23, a pair of opposed side panels 24 and a pair of end panels 27. One of the end panels is provided with an opening 28 having a plurality of angled internal wall panels 30 extending rearwardly therefrom to form a funnel shaped configuration adjacent to said opening 28.

6 Claims, 1 Drawing Sheet

SPAGHETTI BOX DISPENSER CONSTRUCTION

BACKGROUND OF THE INVENTION

1. Field of the Invention

The present invention relates to the field of special containers in general and, in particular, to a box which is specifically designed to facilitate the dispensing of spaghetti.

2. Description of Related Art

As can be seen by reference to the following U.S. Pat. Nos. 4,953,781; 3,981,430; 4,142,635; 4,216,861; and 4,377,237, the prior art is replete with myriad and diverse specialized container constructions.

While all of the aforementioned prior art constructions are more than adequate for the basic purpose and function for which they have been specifically designed, they are uniformly deficient with respect to their failure to provide a simple, efficient, and practical construction for spaghetti boxes that is designed to overcome the problems that are encountered with most conventional spaghetti box constructions.

In particular, the conventional spaghetti box constructions fall into two distinct categories wherein both categories involve a generally elongated rectangular box; wherein one category has a large mouthed opening which invariably dispenses a larger quantity of spaghetti than is needed, necessitating a portion of the dispensed spaghetti to be returned to the container; and, wherein the other category has an undersized opening that not only limits the quantity of spaghetti that can be dispensed at any one time, but which also traps the ends of the strands of spaghetti against the planar surface adjacent to the container opening.

In this latter instance, the user must jiggle and shake the box to align the ends of the strands of spaghetti with the box opening and not only is the process time consuming, but it also results in the breakage of the fragile strands of spaghetti.

As a consequence of the foregoing situation, there has existed a longstanding need for a new and improved spaghetti box dispenser construction having angled interior walls which serve to funnel the strands of spaghetti towards the box opening and the provision of such a construction is the stated objective of the present invention.

BRIEF SUMMARY OF THE INVENTION

Briefly stated, the spaghetti box dispenser construction that forms the basis of the present invention comprises, in general, an external housing unit, an internal wall unit and a closure unit.

As will be explained in greater detail further on in the specification, the housing unit is provided with an opening having a plurality of generally opposed sides; wherein, the internal wall unit comprises a plurality of angled internal wall panels 30 which extend rearwardly from the opening to funnel the contents of the housing unit towards the opening.

In addition, the angled internal wall panels are arranged such that the ends of the strands of spaghetti will contact an angled wall surface to promote the sliding delivery of the individual strands of spaghetti towards the mouth of the opening; and, to eliminate the contact of the flat ends of the strands of spaghetti with the perpendicular wall surfaces found in conventional boxes of spaghetti having a discrete dispensing opening.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
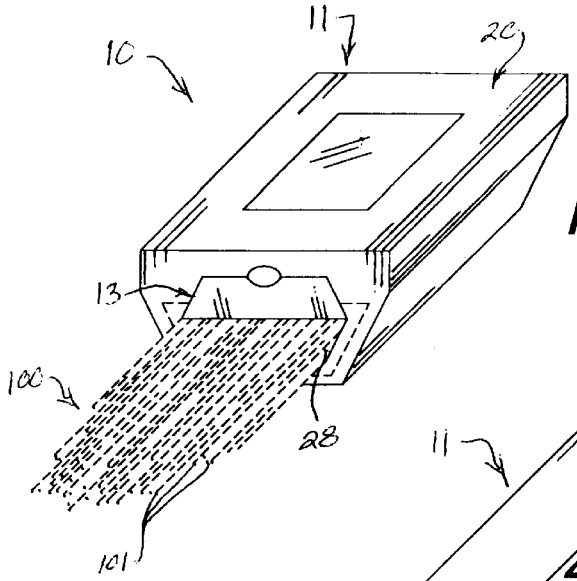
FIG. 1 is a perspective view of the spaghetti box construction dispensing spaghetti.

As can be seen by reference to the drawings, and in particular to FIG. 1, the spaghetti box dispenser construction that forms the basis of the present invention is designated generally by the reference number 10. The construction 10 comprises in general an external housing unit 11 an internal wall unit 12 and a closure unit 13. These units will now be described in seriatim fashion.

Figure 2:
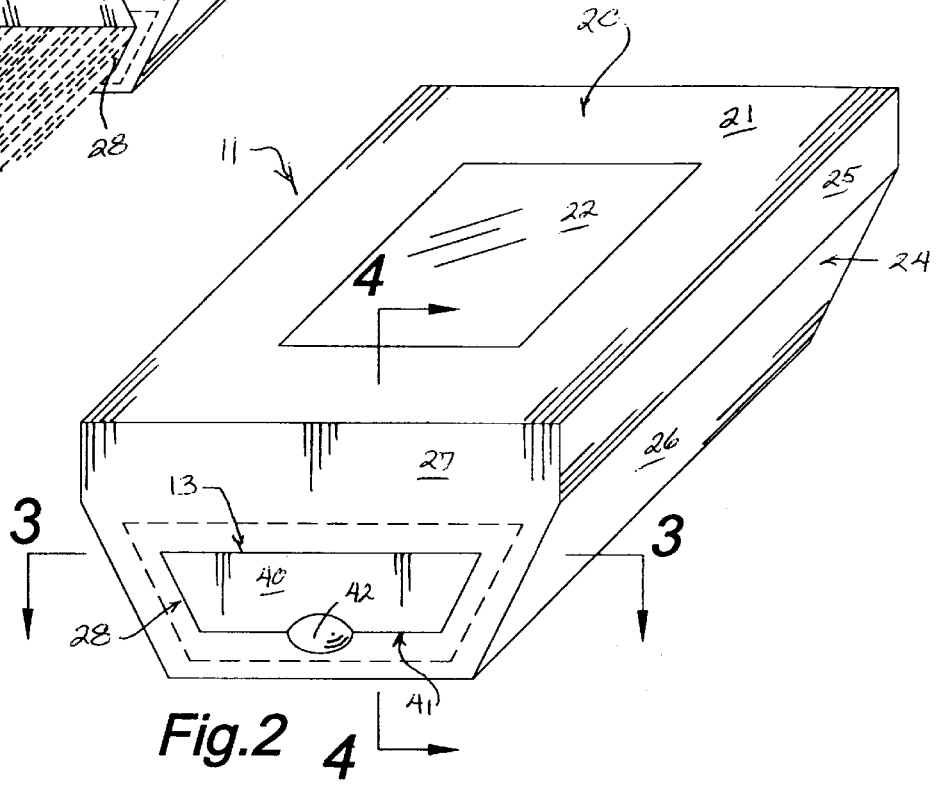
FIG. 2 is an enlarged perspective view of the box construction with the closure unit in the closed position.

As shown in FIGS. 1 and 2, the external housing unit 11 comprises an elongated box member 20 having an enlarged rectangular top panel 21 provided with a transparent window element 22 a narrow rectangular floor panel 23 a pair of side panels 24 having a generally perpendicular upper portion 25 and an angled lower portion 26 and a pair of hexagonal shaped end panels 27 wherein one of the end panels 27 is provided with a reinforced trapezoidal opening 28.

Figure 3:
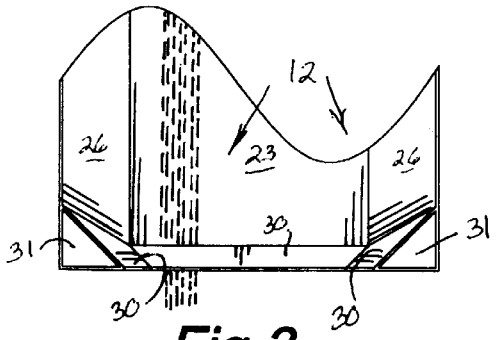
FIG. 3 is a view of the interior of the box construction taken through line 3—3 of FIG. 2.
Figure 4:
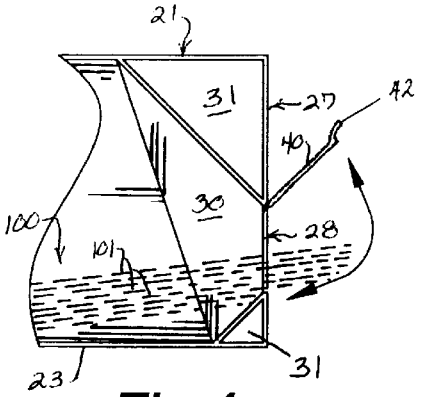
FIG. 4 is a view of the interior of the box construction taken through line 4—4 of FIG. 2.

Turning now to FIGS. 3 and 4, it can be seen that the internal wall unit 12 comprises a plurality of angled internal wall panels 30 which are disposed in a surrounding relationship relative to the opening 28 and extend rearwardly from the opening 28 to their point of attachment with the adjacent top 21, floor 23 and side 24 panels of the box member 20.

As can also be seen by reference to FIGS. 3 and 4, the internal wall panels 30 form a funnel shaped guide for the strands of spaghetti contained within the box member 20 and also form a hollow peripheral chamber 31 which surrounds the box opening 28 such that the strands of spaghetti will slide along the angled internal wall panels 30 rather than becoming trapped against the perpendicular end panel 27 as would be the case with a conventional spaghetti box construction.

As shown in FIGS. 1, 2 and 4, the closure unit 13 comprises a generally trapezoidal shaped closure panel 40 which is hingedly connected to the front end panel 27 and dimensioned to be received in the trapezoidal shaped box opening 28; wherein, the free end 41 of the closure panel 40 is further provided with a radiused lip portion 42 to facilitate the insertion of one of the user's fingernails under the lip portion 42 to disengage the closure panel 40 from the box opening 28.

By now, it should be appreciated that by providing the angled internal wall panels 30 in a surrounding relationship relative to the box opening 28 the individual strands 101 of spaghetti 100 are funneled towards the box opening 28 to facilitate the removal of a desired quantity of spaghetti from the dispenser construction 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A spaghetti box dispenser construction for facilitating the dispensing of a selected quantity of spaghetti without difficulty or breakage wherein the construction comprises:

an external housing unit including an elongated housing member having a top panel, a floor panel, a pair of opposed side panels, and a pair of end panels wherein one of the pair of end panels is provided with an opening having a plurality of generally opposed sides;

an internal wall unit including a plurality of angled internal wall panels that extend rearwardly from at least two of the opposed sides of said opening; and, a closure unit including a closure panel dimensioned to be received in said opening, and having one end hingedly connected to the said one of the pair of end panels at a point adjacent to said opening, and a free end provided with a radiused lip portion.

2. The construction as in claim 1 wherein, said top panel has an enlarged rectangular configuration and is further provided with a transparent window element.

3. The construction as in claim 2, wherein, said bottom panel has a narrow rectangular configuration.

4. The construction as in claim 3 wherein, said end panels have a hexagonal configuration.

5. The construction as in claim 1 wherein, said opening has at least four sides and each of said four sides are provided with one of the plurality of rearwardly angled internal wall panels.

6. The construction as in claim 5 wherein said rearwardly angled internal wall panels converge towards said opening to form a funnel configuration.

* * * * *